US009402285B2

(12) United States Patent
Bond

(10) Patent No.: US 9,402,285 B2
(45) Date of Patent: Jul. 26, 2016

(54) INDOOR PHOTOVOLTAIC FLASHER

(76) Inventor: Michael B. Bond, Boulder, CO (US)

( * ) Notice: Subject to any disclaimer, the term of this patent is extended or adjusted under 35 U.S.C. 154(b) by 0 days.

(21) Appl. No.: 13/507,280

(22) Filed: Jun. 18, 2012

(65) Prior Publication Data

US 2013/0334978 A1 Dec. 19, 2013

(51) Int. Cl.
*H05B 37/00* (2006.01)
*H05B 33/08* (2006.01)
*H05B 37/02* (2006.01)

(52) U.S. Cl.
CPC ..... *H05B 33/0815* (2013.01); *H05B 37/02* (2013.01)

(58) Field of Classification Search
CPC ..... H05B 37/02
USPC ..... 315/200 A, 149–159
See application file for complete search history.

(56) References Cited

U.S. PATENT DOCUMENTS 4,614,879 A * 9/1986 Ault ..... 307/130
5,309,656 A 5/1994 Montgomery
5,924,784 A * 7/1999 Chliwnyj ..... F21S 9/02 307/64
6,013,985 A * 1/2000 Green et al. ..... 315/149
6,593,701 B1 * 7/2003 Hsieh ..... 315/159
7,351,907 B2 4/2008 Gaudiana et al.
7,619,372 B2 * 11/2009 Garrity ..... 315/291
7,649,323 B1 * 1/2010 Kuhlmann ..... H05B 33/0803 315/200 A
9,273,840 B1 * 3/2016 Braun ..... F21S 9/035
2005/0016579 A1 1/2005 Elazari
2005/0274407 A1 12/2005 Curry
2010/0102773 A1 * 4/2010 Lipcsei ..... 320/101
2010/0134014 A1 * 6/2010 Anderson ..... F21L 4/08 315/113
2012/0262067 A1 * 10/2012 Tam et al. ..... 315/119

* cited by examiner

*Primary Examiner* — Tung X Le
(74) *Attorney, Agent, or Firm* — William Propp, Esq.

(57) ABSTRACT

An indoor photovoltaic flasher has a photovoltaic panel to collect ambient indoor light and convert the light into energy; the energy from the photovoltaic panel is stored as voltage in a capacitor; current will flow from the capacitor through a MOSFET to the light emitting diodes display, with the MOSFET being an on/off switch for the light emitting diodes display; and a voltage divider and an integrated circuit will control the MOSFET and determine whether there is sufficient voltage in the capacitor to power the light emitting diodes in the display.

10 Claims, 3 Drawing Sheets

INDOOR PHOTOVOLTAIC FLASHER

BACKGROUND OF THE INVENTION

This invention relates generally to an indoor photovoltaic flasher and, more particularly, this invention is directed to an indoor photovoltaic energy harvesting circuit for powering a flashing indoor light display.

Photovoltaic panels are typically used outdoors in natural sunlight to generate electrical power. Indoor light displays are typically powered by external electrical power or by internal batteries.

U.S. Pat. No. 7,351,907 describes a flexible photovoltaic cell for possible indoor use but the patent only details the photovoltaic cell semiconductor structure of a photosensitized nanoparticle material and a polymeric linking agent.

U.S. Pat. No. 5,309,656 presents an indoor display with photovoltaic energy collection, a storage battery, a timing circuit, and light emitting diodes which illuminate a placard. The timing circuit requires three integrated circuits. The LEDs only illuminate a placard and are not a light display in and of themselves. The LEDs do not provide continuous flashing. The display has a proximity detector and only displays light if someone is near. It does not draw someone from afar down the aisle to the display.

US Patent Application No. 20050274407 uses indoor photovoltaic panels to generate direct current electric power, which is converted to alternating current electrical power, to supply current to standard indoor electric lighting fixtures. The indoor photovoltaic panels will have to be sufficiently large in area with a high energy extraction efficiency to generate enough current for just one low watt lighting fixture. The patent application is scanty on operating elements and operating details. The application does not disclose a display system.

US Patent Application No. 20050016579 discloses an array of solar cells for use indoors to power handheld electronic devices such as cell phones and portable computers. The only electronics shown for the solar cells is a blocking diode to protect the solar cells from a reverse power flow. The patent application does not show any displays.

It is an object of this invention to provide an indoor photovoltaic panel for powering a flashing light display.

It is another object of this invention to provide an indoor flashing light display without the use of an external power source or a battery power source.

It is yet another object of this invention to provide an indoor photovoltaic panel for powering an indoor light display where the indoor light display is brighter than the indoor ambient light.

SUMMARY OF THE INVENTION

According to the present invention, an indoor photovoltaic flasher has a photovoltaic panel to collect ambient indoor light and convert the light into energy; the energy from the photovoltaic panel is stored as voltage in a capacitor; current will flow from the capacitor through a MOSFET to the light emitting diodes display, with the MOSFET being an on/off switch for the light emitting diodes display; and a voltage divider and an integrated circuit will control the MOSFET and determine whether there is sufficient voltage in the capacitor to power the light emitting diodes in the display.

A two resistor voltage divider will scale down the voltage from the capacitor. The integrated circuit will compare the scaled down voltage from the capacitor versus a reference threshold voltage needed to power the light emitting diodes display. When the comparison shows that sufficient voltage has been stored in the capacitor to power the light emitting diodes display, the integrated circuit will enable the MOSFET to allow current flow from the capacitor through the MOSFET to the light emitting diodes display to emit light. The light emitting diodes display will remain on so long as there is sufficient voltage in the capacitor for the light emitting diodes display to emit light. As the light emitting display emits light, it will delete the voltage from the capacitor. When the comparison shows that insufficient voltage has been stored in the capacitor to power the light emitting diodes display, the integrated circuit will disable the MOSFET to prevent current flow from the capacitor through the MOSFET to the light emitting diodes display to emit light. The capacitor will then store increasing voltage from the energy from the photovoltaic panel. The on/off pattern from the MOSFET as the voltage charges and discharges from the capacitor will produce an attention attracting flashing light display from the light emitting diodes display.

Other aspects of the invention will become apparent from the following more detailed description, taken in conjunction with the accompanying drawings.

BRIEF DESCRIPTION OF THE DRAWINGS

The preferred embodiments of this invention will be described in detail, with reference to the following figures wherein.

DETAILED DESCRIPTION OF PREFERRED EMBODIMENTS

List of Elements

Figure 1:
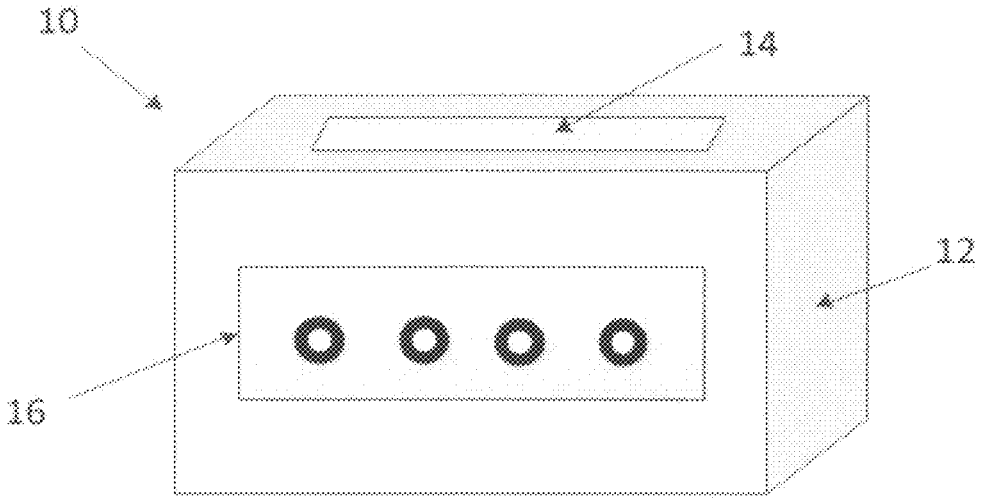
FIG. 1 is a perspective view of the indoor photovoltaic flasher of the present invention.

10 Indoor photovoltaic flasher
12 Component body
14 Photovoltaic panel
16 Light emitting diodes display
18 Aisle side
20 Display shelf
22 Indoor ambient light
24 Direct fluorescent light
26 Indirect fluorescent light
28 Direct incandescent light
30 Indirect incandescent light
32 Direct sunlight
34 Indirect sunlight
100 Indoor photovoltaic flasher
102 Photovoltaic panel
104 Capacitor (C1)
106 MOSFET
108 Light emitting diodes display
110 Voltage divider
112 Integrated circuit (UVSC)
114 Second resistor (R2)
116 Third resistor (R3)
118 Series capacitor (C2)
120 Third capacitor (C3)
122 Capacitive voltage divider
124 Ground
126 Current-limiting first resistor (R1)

Reference is now made to FIG. 1 illustrating the indoor photovoltaic flasher 10 of the present invention. The electronic circuitry for the indoor photovoltaic flasher is inside the component body 12. The external elements of the indoor photovoltaic flasher are (1) the photovoltaic panel 14 for collecting indoor ambient light and converting the light into energy and (2) the light emitting diodes display 16 for providing an attention attracting, flashing light display. The photovoltaic panel 14 and light emitting diodes display 16 can be on any surface of the component body 12 or even remote from the component body and connected by electrical wires to the component body.

Figure 2:
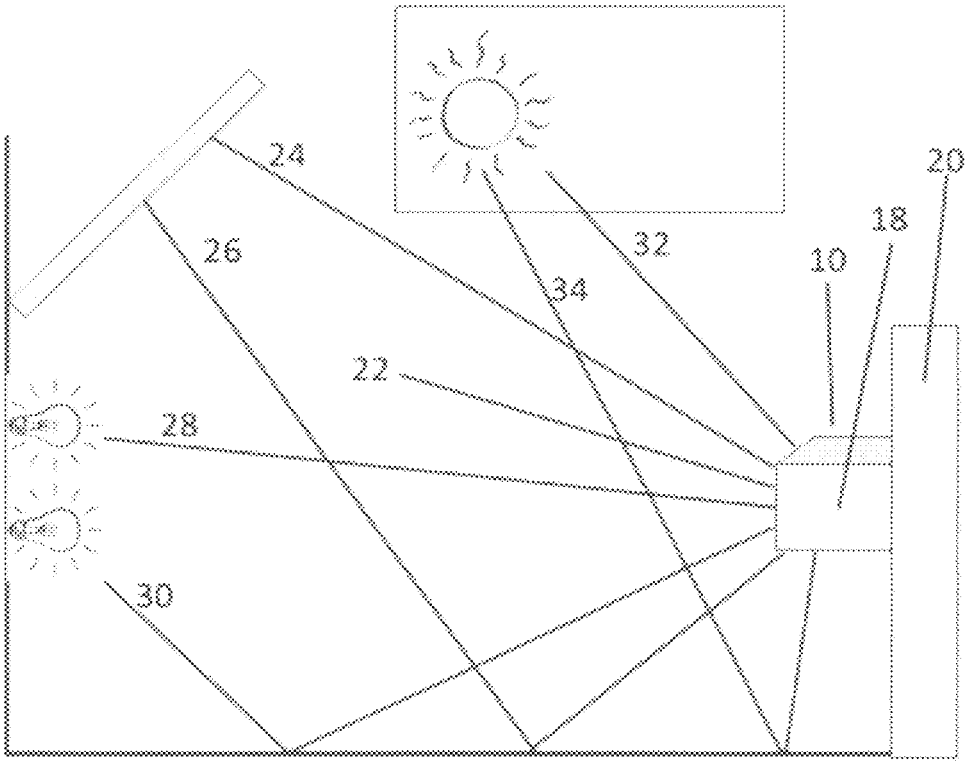
FIG. 2 is a perspective view of the indoor photovoltaic flasher of the present invention being used in a store as a flashing light display.

FIG. 2 shows the indoor photovoltaic flasher 10 being used inside a store as a display. The photovoltaic flasher 10 is attached to the aisle side 18 of a display shelf 20 to draw attention to the products on display. Indoor ambient light 22 is incident on the photovoltaic panel 14 of the indoor photovoltaic flasher 10. The photovoltaic panel 14 collects the ambient light and converts the ambient light into energy. The light emitting diodes display 16 flashes a light display to attract customers. The indoor photovoltaic panel will power an indoor light display based on indoor ambient light where the indoor light emitting diodes display is brighter than the indoor ambient light. The indoor solar panel eliminates the need for an external power source or an internal battery source to power the indoor light emitting diodes display.

The light source for the photovoltaic panel will be indoor ambient light. The indoor ambient light can be artificial light or natural light or a combination of the two types of light.

The artificial light can be direct fluorescent light 24 or indirect fluorescent light 26; direct incandescent light 28 or indirect incandescent light 30; or direct or indirect light from any other visible light source or any combination thereof The natural light can be direct sunlight 32 or indirect sunlight 34.

The photovoltaic panel 14 will generate energy from light in the visible spectrum so the ambient light 22, whether artificial light or natural light, whether direct light or indirect light, needs to be in the visible spectrum.

The in-store display is merely an illustrative example of the uses of the indoor photovoltaic flasher 10 of the present invention.

Figure 3:
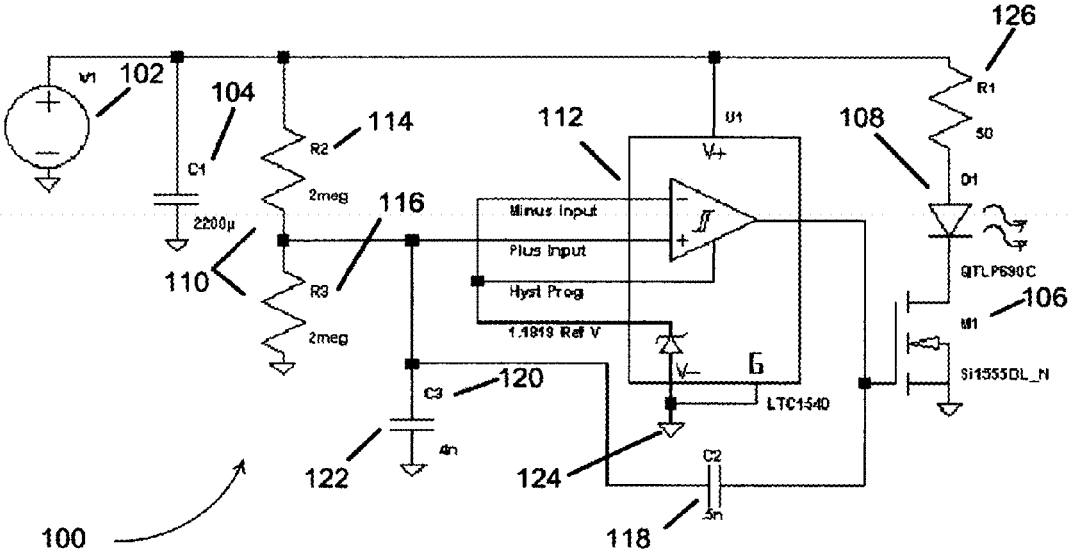
FIG. 3 is the electronic schematic of a first embodiment of the indoor photovoltaic flasher of the present invention.

The indoor photovoltaic flasher 100 of the present invention in FIG. 3 has a photovoltaic panel 102 to collect ambient indoor light and convert the light into energy; the energy from the photovoltaic panel is stored as voltage in a capacitor 104; current will flow from the capacitor 104 through an enhancement mode, N-MOSFET 106 to the light emitting diodes display 108, with the N-MOSFET 106 being an on/off switch for the light emitting diodes display 108; and a voltage divider 110 and an integrated circuit 112 will control the N-MOSFET 106 and determine whether there is sufficient voltage in the capacitor 104 to power the light emitting diodes in the display 108.

A two resistor voltage divider 110 will scale down the voltage from the capacitor 104. The integrated circuit 112 will compare the scaled down voltage from the capacitor versus a reference threshold voltage needed to power the light emitting diodes display 108. When the comparison shows that sufficient voltage has been stored in the capacitor 104 to power the light emitting diodes display 108, the integrated circuit 112 will enable the N-MOSFET 106 to allow current flow from the capacitor through the N-MOSFET to the light emitting diodes display to emit light. The light emitting diodes display will remain on so long as there is sufficient voltage in the capacitor for the light emitting diodes display to emit light. As the light emitting display emits light, it will deplete the voltage from the capacitor. When the comparison shows that insufficient voltage has been stored in the capacitor to power the light emitting diodes display, the integrated circuit 112 will disable the N-MOSFET 106 to prevent current flow from the capacitor through the N-MOSFET to the light emitting diodes display to emit light. The capacitor 104 will then store increasing voltage of the energy from the photovoltaic panel 102. The on/off pattern from the N-MOSFET as the voltage charges and discharges from the capacitor will produce an attention attracting flashing light display from the light emitting diodes display.

Ambient indoor light is incident on the photovoltaic panel 102. The photovoltaic panel can be an array of thin film amorphous silicon cells. The photovoltaic panel 102 converts the light into energy which is transferred and stored as voltage in an adjacent capacitor 104. Direct transfer of the voltage from the capacitor 104 to the light emitting display 108 provides insufficient voltage to power the light emitting diodes to emit light. Energy from the solar photovoltaic panel is transferred and stored as voltage in the adjacent first capacitor 104 C1 to build up the voltage until there is sufficient voltage to light the light emitting display 108 for a period of time long enough for the light to be seen by the human eye.

The integrated circuit 112 functions as an Under-Voltage Supervisory Circuit (UVSC). The UVSC disables the N-MOSFET 106 preventing the flow of current from the capacitor 104 to the light emitting diodes in the display 108 until the circuit has determined that a sufficient voltage exists in the capacitor to fully power the light emitting diodes for a sufficient period of time. If the UVSC integrated circuit 112 determines there is a sufficient voltage in the capacitor 104 to fully power the light emitting diodes 108 for a sufficient period of time, then the UVSC integrated circuit 112 will enable the N-MOSFET 106 allowing the flow of current from the capacitor 104 to the light emitting diodes in the display 108.

The UVSC integrated circuit 112 makes this determination of sufficient voltage by comparing a scaled down version of the capacitor's voltage, Vscaled, to a pre-determined reference voltage, Vreference, in the UVSC.

The scaled down voltage from the capacitor 104 is determined by a voltage divider 110 composed of a second resistor 114 R2 and a third resistor 116 R3.

The scaling factor is determined by the formula:

$$V\text{scaled}=R3/(R2+R3)*V\text{capacitor} \quad \text{[Equation 1]}$$

When R3=R2, as is the case in FIG. 3, the scaling factor is ½.

The predetermined reference voltage is provided by the Under-Voltage Supervisory Circuit (UVSC) integrated circuit 112. The scaled down capacitor Voltage to reference Voltage comparison operations is carried out by the Under-Voltage Supervisory Circuit (UVSC) integrated circuit.

The Under-Voltage Supervisory Circuit (UVSC) integrated circuit contains two components: (1) the reference voltage, Vreference, which is provided by a semiconducting diode structure operated in its reverse breakdown region, and (2) a Hysteretic Analog Comparator (HAC), which is a high-gain operational amplifier operated open-loop with a hysteresis applied to the input.

The HAC's hysteresis function is disabled by connecting the "Hyst Prog" pin of the HAC directly to the reference voltage. De-glitching is effectively achieved through a feedback signal on the positive feedback pathway provided by a series capacitor 118, the second capacitor C2, which connects the output of the integrated circuit's analog comparator to the non-inverting input of integrated circuit's analog comparator.

The Under-Voltage Supervisory Circuit (UVSC) integrated circuit 112 in this illustrative example is an LTC1540 ("Nanopower Comparator with Reference") from Linear Technologies Corp. Any low-power voltage reference and analog comparator with sufficient voltage withstanding would work for this invention. However, the LTC1540 can operate over a wide range of input voltages, from 2V to 11V and uses an ultra-low amount of power, less than 0.6 uA of current over its entire temperature range. This ultra-low amount of power is well below the power drain of the vast majority of similar integrated circuits.

The HAC compares the scaled down capacitor 104 C1 voltage, Vscaled, with the voltage reference's, Vreference, constant value (1.182V for the LTC1540). Scaling is necessary to reduce the cost, complexity, and energy required for the comparison operation. The comparison operation cannot be done at the native voltage of capacitor 104 C1 without additional supporting electronic circuitry. The reference voltage, Vreference, is connected to the HAC's inverting (minus) input and the scaled capacitor voltage, Vscaled, to its non-inverting (plus) input. As such, the HAC expresses a logic "high" (Voltage=Vcapacitor) level at its output when Vscaled>Vreference and a logic "low" (Ground) otherwise.

The trigger voltage, Vtrigger, which is the voltage across the capacitor 104 C1 at the time that Vscaled=Vreference. The trigger Voltage, Vtrigger, may be calculated by inverting the prior Equation 1 yielding:

$$V\text{trigger}=(R2+R3)/R3*V\text{reference} \quad \text{[Equation 2]}$$

The output of the HAC of the integrated circuit 112 is connected to an enhancement-mode n-channel field-effect transistor (N-MOSFET) 106, which functions as a power switch to the light emitting diodes in the display 108. The term "connected" means physically and electrically connected. When the HAC output is high and Vscaled exceeds Vreference, the N-MOSFET 106 allows current flow from the capacitor 104 through the light emitting diodes display 108. When the HAC output is low and Vreference exceeds Vscaled, the MOSFET 106 prevents current flow from the capacitor 104 through the light emitting diodes display 108.

When a sufficient voltage has been reached in the capacitor 104 to fully power the light emitting diodes display 108 for a sufficient period of time, as determined by the integrated circuit 112 and the R2-R3 resistive voltage divider 110, the light emitting diodes in the display 108 are switched on by the first MOSFET 106. At this point, the light emitting diodes are on, and the voltage stored in the main capacitor 104 C1 will be falling.

Once the voltage has fallen to where the capacitor 104 is unable to fully power the light emitting diodes display 108 for a sufficient period of time, the UVSC integrated circuit 112 disables the current flow to the light emitting diodes in the display 108 by the MOSFET 106 and the capacitor 104 C1 will build up its stored voltage from the photovoltaic panel 102.

A series capacitor 118 (second capacitor C2) connects the output of the integrated circuit's analog comparator to the non-inverting input of integrated circuit's analog comparator creating a feedback signal on the positive feedback pathway. Capacitors have a frequency dependent impedance acting as a short circuit at high frequencies and an open circuit at low frequencies.

The first capacitor 104 C1 reaches the critical voltage to fully power the light emitting diodes for a sufficient period of time. Due to the high gain of the integrated circuit's analog comparator, reaching the critical voltage is a highly non-linear event and, accordingly, contains a broad spectrum of frequencies. The series installation of the second capacitor 118 C2 in the feedback pathway means that only the high-frequency portion of this spectrum passes through and back to the non-inverting input of the integrated circuit's comparator. A third capacitor 120 C3 is added in shunt with the non-inverting input to form a capacitive voltage divider 122 with the second capacitor 118 C2 to limit the magnitude of the feedback signal to prevent too large of a voltage or negative voltages from appearing on the "Plus Input".

The voltages on this "Plus Input" superpose (i.e. add constructively) raising the value above its normal scaled value (the value of C1 divided by 2 for the values of R2 and R3). The sustaining low-frequency (DC) components do not make it through the second capacitor 118 C2 as the second capacitor 118 C2 presents a high-impedance (open-circuit) to this portion of the signal. As a result, the voltage at the non-inverting input will rapidly fall towards its 'normal' value (half of the voltage on C1).

The mechanism of return involves three pathways. Some of the current will drain off through the third resistor 116 R3, some of the current (the high frequency part of the current) through the third capacitor 120 C3, and some of the current (a very little part of the current) will leak through the input of the integrated circuit 112 back to ground 124. With carefully chosen component values for capacitors 118 C2 and 120 C3, and resistors 114 R2 and 116 R3, the circuit 112 may be designed such that it will take about 10 milliseconds before the voltage on the "Plus Input" falls below the reference voltage on the "Minus Input" (1.1819v). When this occurs, the light emitting diodes display 108 will be switched off and the main capacitor 104 C1 will slowly be recharged by the photovoltaic panel source 102. When the main capacitor 104 C1 reaches the trigger threshold again, the cycle repeats.

The Light Emitting Diodes (LEDs) of the display 108 are connected to its power source of the first capacitor 104 C1 through a current-limiting first resistor 126 R1 which seeks to limit the current through the light emitting diodes display 108 to a "safe" value. The current from the capacitor through the light emitting diodes display changes rapidly for very small changes in voltage. The light emitting diode will fail for continuous operation above 20 mA. Excess current through the light emitting diode would result in the light emitting diode semiconductor structure melting and its subsequent failure.

The On-Off control of the light emitting diode is exercised through the enhancement-mode n-channel field effect transistor (N-MOSFET) M1 106. The N-MOSFET has three terminals: (1) a gate, (2) a source, and (3) a drain. The controlling on-off signal is applied between the gate and the source. The switch action occurs between the drain and the source. Virtually no current flows into the input under steady-state conditions, due to the high input impedance of the channel-insulated gate terminal. However, a large current may flow between the drain and the source (the output channel) when the gate-to-source voltage is sufficiently large as the channel is "enhanced" by the gate voltage making it highly conductive (low resistance). The resistance of the channel in this state is designated R ON. The N-MOSFET is a Vishay Semiconductor Si1555DL. With the unsealed reference Voltage, Vtrigger, of FIG. 3's design (2.36V), R ON is approximately 0.6 Ω.

The light emitting diode 108 is a T1 (3 mm), radial packaged, 626 nanometer wavelength (red), high-efficiency, diffused light emitting diode. The light emitting diode can be an Avago 136 HLMP-1301 or a QTLP690C.

A 10 milliseconds pulse is an optimum pulse time for the flashing light display 108, due to the human eye response. A 5 milliseconds pulse will appear only about half as bright to the human eye than a 10 milliseconds pulse. A 15 milliseconds pulse will not appear brighter than a 10 milliseconds pulse, it will simply last 5 milliseconds longer.

The size of the capacitor 104 C1 is determined by several constraints. The capacitor must store sufficient energy to fully power the light emitting diodes 108 for a duration long enough to be detected (seen) by the human eye. The capacitor voltage, since it is related to the current flowing in the light emitting diodes by first resistor 126 R1, must remain large enough to ensure sufficient current flow to keep the light emitting diodes lit.

For a 1.8V light emitting diode at 10 mA of illumination current for 10 milliseconds, the minimum value of the first capacitor 104 C1 is 530 uF. The indoor photovoltaic flasher 100 of the present invention uses a value one order of magnitude larger to account for the non-ideal behavior of actual electronic components and to provide margin against temperature and manufacturing variability. Larger values of the first capacitor 104 C1 produce more stable operation of the indoor photovoltaic flasher over time, but will substantially increase the warm up time (the time between illumination and the first flashing operation) when the first capacitor 104 C1 is completely discharged.

The indoor photovoltaic flasher will power an indoor light display based on indoor ambient light where the indoor light emitting diodes display is brighter than the indoor ambient light. Solar-powered lights are common, but these normally store energy for later use in periods of darkness. The photovoltaic panel eliminates the use of batteries (and their associated maintenance) and allows the use of a flashing light display in daylight indoors.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An indoor photovoltaic flasher comprising a photovoltaic panel to collect ambient indoor light and convert the light into energy;

a first capacitor to store the energy as voltage from said photovoltaic panel;

a light emitting diodes display;

a MOSFET wherein current flows from said first capacitor through said MOSFET to said light emitting diodes display, said MOSFET being an on/off switch for engaging or disengaging current flow from said first capacitor to said light emitting diodes display;

a voltage divider and a first integrated circuit to control said first MOSFET; wherein said voltage divider scales down the voltage from said first capacitor; said first integrated circuit compares said scaled down voltage stored in said first capacitor versus a reference threshold voltage; and said first integrated circuit determines whether there is sufficient voltage in said first capacitor to power said light emitting diodes display, and wherein said first integrated circuit is an Under-Voltage Supervisory Circuit having a semi-conducting diode structure to provide said reference threshold voltage and a hysteretic analog comparator to compare said scaled down voltage stored in said first capacitor versus said reference threshold voltage.

2. The indoor photovoltaic flasher of claim 1 wherein said light emitting diodes display is a flashing light display.

3. The indoor photovoltaic flasher of claim 2 wherein 10 milliseconds is the pulse time for said flashing light display.

4. The indoor photovoltaic flasher of claim 1 wherein said voltage divider is a two resistor voltage divider.

5. The indoor photovoltaic flasher of claim 1 wherein said hysteretic analog comparator of said Under-Voltage Supervisory Circuit is connected to said MOSFET to enable or disable said current flow from said first capacitor to said light emitting diodes display.

6. The indoor photovoltaic flasher of claim 1 further comprising a second capacitor which connects the output of said hysteretic analog comparator to the non-inverting input of said hysteretic analog comparator creating a feedback signal.

7. The indoor photovoltaic flasher of claim 6 further comprising a third capacitor added to said second capacitor to form a capacitive voltage divider to limit the magnitude of said feedback signal.

8. The indoor photovoltaic flasher of claim 1 further comprising a resistor in said current flow between said first capacitor and said light emitting diodes display to limit the current.

9. The indoor photovoltaic flasher of claim 1 wherein said first integrated circuit is an LTC1540 (Nanopower Comparator with Reference).

10. The indoor photovoltaic flasher of claim 1 wherein said first MOSFET is an enhancement-mode n-channel field-effect transistor.

* * * * *